United States Patent [19]

Shivers, Jr.

[11] Patent Number: 4,547,325

[45] Date of Patent: Oct. 15, 1985

[54] CARBURETOR FOR INTERNAL COMBUSTION ENGINES

[76] Inventor: Charles B. Shivers, Jr., 816 S. 82nd St., Birmingham, Ala. 35206

[21] Appl. No.: 627,059

[22] Filed: Jul. 2, 1984

[51] Int. Cl.[4] ..... F02M 3/08

[52] U.S. Cl. ..... 261/65; 261/DIG. 2; 261/DIG. 20

[58] Field of Search ..... 261/DIG. 20, DIG. 2, 261/65

[56] References Cited

U.S. PATENT DOCUMENTS

| | | | |
|---|---|---|---|
| 1,774,725 | 9/1930 | Remington | 261/65 |
| 3,047,277 | 7/1962 | Landrum | 261/65 |
| 3,365,179 | 1/1968 | La Force | 261/65 |
| 4,066,721 | 1/1978 | Graham | 261/65 |
| 4,277,424 | 7/1981 | Shivers, Jr. | 261/DIG. 2 |
| 4,356,801 | 11/1982 | Graham | 261/65 |

FOREIGN PATENT DOCUMENTS

| | | | |
|---|---|---|---|
| 433083 | 8/1926 | Fed. Rep. of Germany | 261/65 |
| 2805091 | 8/1979 | Fed. Rep. of Germany | 261/65 |
| 171980 | 1/1923 | United Kingdom | 261/65 |

*Primary Examiner*—Tim Miles

*Attorney, Agent, or Firm*—Woodford R. Thompson, Jr.

[57] ABSTRACT

Disclosed is a carburetor for internal combustion engines which minimizes the effect on the engine of carburetor ice.

To overcome the effect of ice build-up the throttle valve on the side adjacent the idle jet, is bent upstream, thus providing a greater opening between the idle jet and the adjacent part of the throttle valve and a lesser opening on the opposite side of the throttle valve at idle and intermediate throttle openings. Increasing the operating angle of the idle jet half of the throttle valve upstream, toward the vertical position, deters the build-up of ice. Furthermore my invention exposes an ice deposit to the incoming fuel-air mixture, causing early erosion of the same and elimination of prolonged operation with over-rich or lean mixtures.

1 Claim, 5 Drawing Figures

CARBURETOR FOR INTERNAL COMBUSTION ENGINES

BACKGROUND OF THE INVENTION

This invention relates to carburetors for internal combustion engines, and while not limited thereto, is directed particularly to carburetors employed on aircraft engines, and is an improvement over that disclosed and claimed in my prior Pat. No. 4,277,424, dated July 7, 1981.

One of the known and primary causes of aircraft engine failure is carburetor icing. My investigation into this problem leads me to believe that little real, sound information is available on carburetor icing, particularly with regard to the places in the carburetor where ice forms and the effect thereof on the operation of the engine, and interference with fuel metering.

My investigations have revealed that the primary cause of engine failure or partial failure due to carburetor ice comes about because ice builds up on the engine side (downstream side) of the throttle valve.

Most aircraft carburetors are provided with both idling systems and main jet systems to supply the fuel to the air stream flowing through the carburetor body. In aircraft carburetors (and, so far as I am aware, most automobile carburetors) it is customary for the idle jet system to be in communication with the main jet system, although such is not always the case.

Recognition of carburetor icing is generally limited to the build-up of ice which occurs around the upstream outer rim of the throttle valve, between the outer rim of the throttle valve and the carburetor wall, closing or restricting the air passage and causing engine stall under certain atmospheric conditions.

In addition to this type icing I have discovered that ice commences to form on the engine side of the throttle valve on the side or quadrant adjacent the idle jet. Thus, with the throttle valve in partially closed position the ice may cover substantially one-half of the throttle valve; continued build-up of ice may occur on the downstream side of the throttle valve adjacent the idle jet even when the throttle valve is in the substantially full open position. Thus, substantially the entire surface of the throttle valve becomes covered with ice, which ice cake extends to the side walls of the carburetor body, adjacent the idle jet. In either partial or full open position of the throttle valve there is a restriction of flow of air through the carburetor body adjacent the idle jet, resulting in a tremendous reduction in pressure at the mouth of the idle jet and in the idle jet system. Since this system is in communication with the main jet system, under either of these conditions I have discovered that instead of fuel being inspirated from the main jet, there is fuel starvation of that jet simply because there is greater negative pressure at the fuel supply end of the main jet than at the fuel discharge thereof. Under these circumstances the main jet is starved of fuel. Since the effective diameter of the idle jet is less than that of the main jet the idle jet is too small to supply the requisite quantity for full engine operation. Furthermore, with partial build-up of ice on the throttle valve and at partial opening of the throttle valve, there can be a condition resulting in mixture so rich as to cause engine failure or at the least rough operation and a waste of fuel. Continued operation under the latter conditions, namely without changing the throttle setting, can result in engine failure due to an over-rich or lean mixture (limited generally to a rich mixture in systems where the idle passage and main passage are not in communication).

DESCRIPTION OF THE DRAWINGS

A carburetor illustrating features of my invention is shown in the accompanying drawings, forming a part of this application, in which.

DETAILED DESCRIPTION

Figure 1:
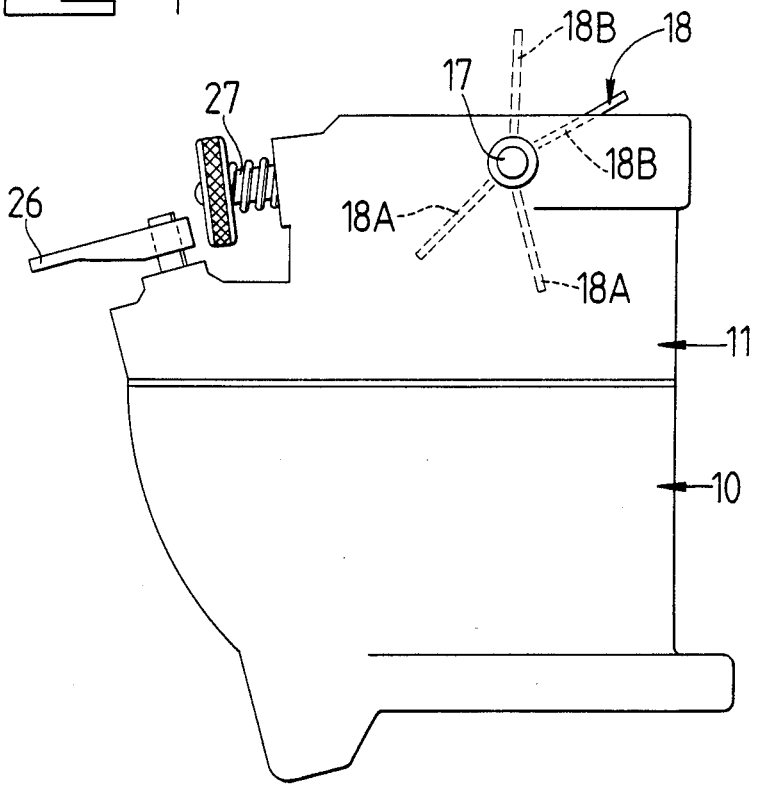
FIG. 1 is a side elevational view of a carburetor equipped with my improved mechanism.
Figure 2:
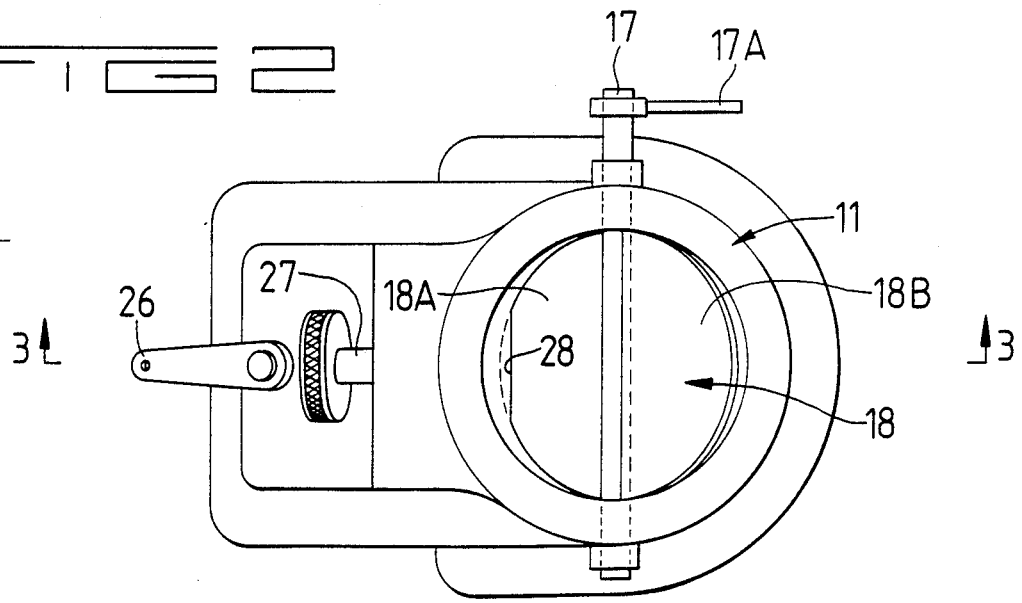
FIG. 2 is a plan view.

Referring now to the drawings for a better understanding of my invention, I illustrate the same in association with a typical updraft carburetor which may be employed on aircraft engines, downdraft or sidedraft carburetors on most automobile engines, and throttle bodies of fuel injection systems. Thus, the carburetor comprises the lower section 10 and the upper section 11. As is known, the lower section may comprise a main jet 12, suitably placed relative to a venturi assembly 13 and drawing fuel through a passage 14. Fuel is supplied from a carburetor bowl, a portion of which is indicated by the space 16, and air is supplied through passage 31.

The upper portion of the carburetor comprises a shaft 17 which carries a throttle valve 18. An arm 17A on one end of shaft 17 may have connected thereto a throttle control wire or the like. The idle system of the carburetor comprises the lower fuel passageway 19 which connects to and communicates with an upper fuel passageway 21. The idle jet 22 itself generally is simply a passage through the wall of the carburetor body.

It will be seen that the lower end of the passage 19 connects as at 23 to the main jet fuel supply passage 14, however not limited thereto.

At 24 I show the usual cut-off valve which is under control of a lever 26, which lever generally is connected to a suitable control in the cockpit of the aircraft. When this lever is turned to a certain position, all of the fuel to both jets 12 and 22 is cut off, stopping the engine.

Also, as will be understood, the idle jet 22 is adjustable by means of the threaded manual screw 27.

Figure 3:
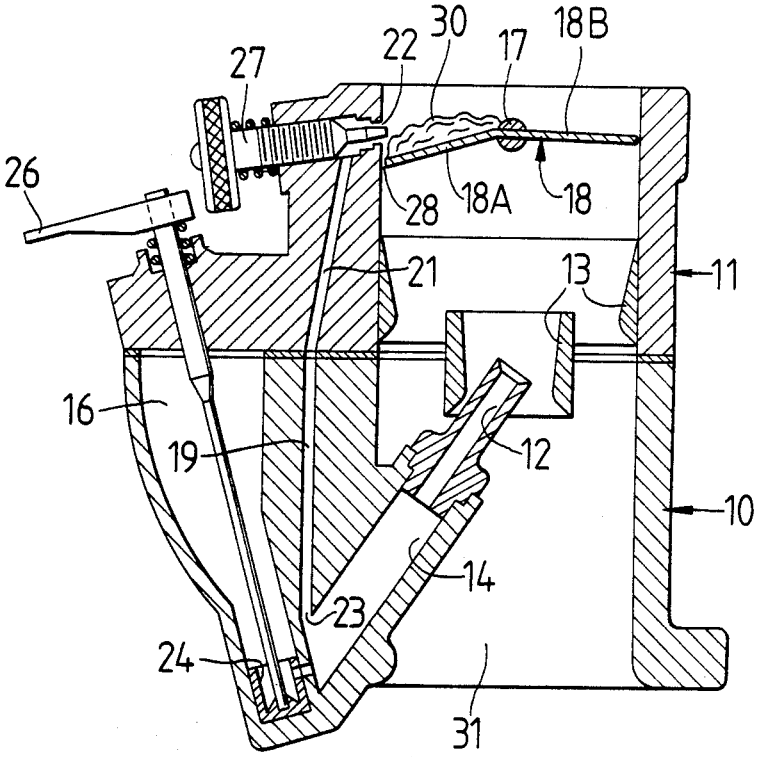
FIG. 3 is a detail sectional view taken generally along line 3—3 of FIG. 2 and showing a partial build-up of ice on the butterfly valve.

My invention comprises means to effectively change the operating angle of the throttle valve during engine operation. To this end I provide an upstream bend in the idle jet half of the throttle valve 18, adjacent the idle jet side of the throttle rod, as shown. 18A designates the idle jet half of the throttle valve, controlling that part of the upstream fuel-air passage 31, referred to as the primary opening. 18B designates the opposing half of the throttle valve which controls the other part of the opening and as shown in FIG. 3 this portion of the throttle valve 18 is perpendicular to the passage at its full closed position referred to as the secondary opening.

The outer rim of the throttle valve 18A may have a portion removed as at 28, compensating the delayed opening of side 18B, at idle and intermediate throttle settings, also providing an increased fuel-air passage adjacent the idle jet, further reducing the likelihood of ice build-up at this point.

Figure 5:
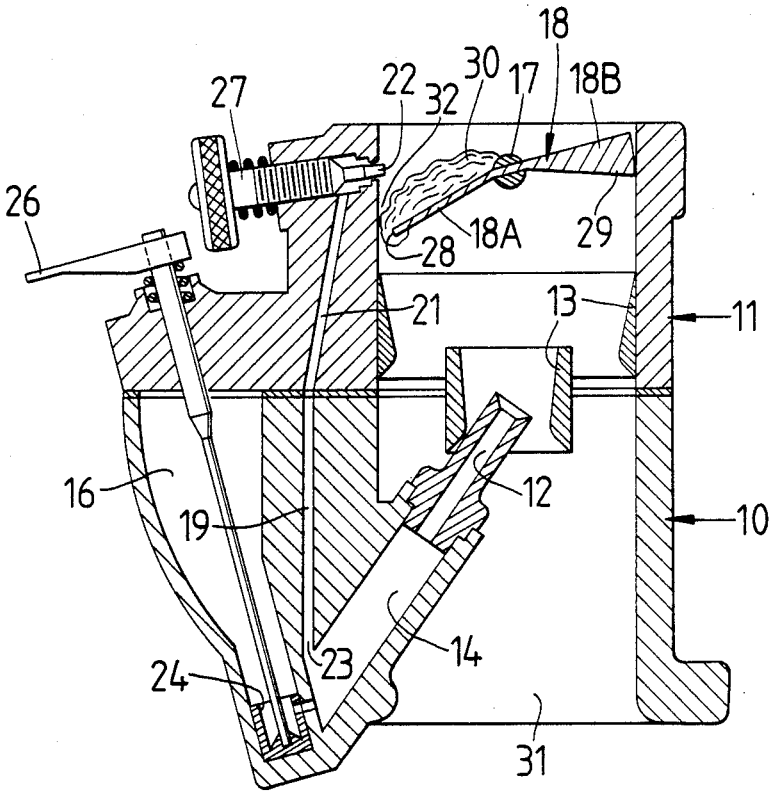

My improved throttle valve is installed as usual in the throttle shaft 17 and is operated in the conventional manner. The throttle valve may also have its thickness increased on side 18B, upstream side, to provide a further delayed opening of the secondary passage, as shown at 29 in FIG. 5.

With the foregoing construction in mind, the advantages of my improved carburetor may be readily understood.

As before stated, ice as indicated at 30, FIG. 3, commences to build whenever the conditions for the same are correct, namely whenever the moisture-temperature conditions conducive to ice prevail in the body of air flowing through the carburetor. With the throttle set at slightly open positions as shown in FIG. 3, and, with the ice commencing to build it will be apparent that there is a decrease in space between the body of ice and the mouth of the idle jet 22. In view of the fact that jet 22 and jet 12 both draw their fuel from the same common passageway 14, whenever the negative pressure at the end of jet 22 exceeds the negative pressure at the inspiration end of jet 12, fuel ceases to flow from jet 12 and can only flow through the idling jet 22.

Figure 4:
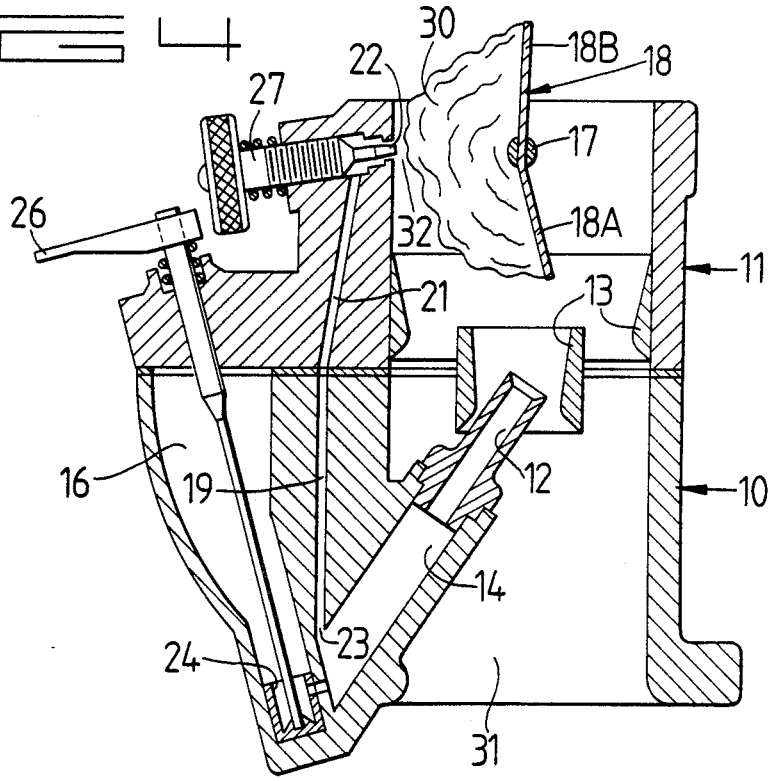
FIG. 4 is a view corresponding to FIG. 3 with the throttle valve in full open position and showing ice formed thereon, substantially covering the same; and, FIG. 5 is a modification to further delay the intake opening of the secondary part of the air-fuel passageway.

Under the conditions shown in FIG. 4 of the drawings, ice has built substantially to the point of covering the entire upper or engine side of the throttle valve 18. With a carburetor not equipped with my improved throttle valve, the passage between the discharge end of jet 22 and the ice indicated at 30, is so small that a tremendous velocity to pressure conversion takes place, thereby producing more negative pressure in the area indicated at 32 than exists at the mouth of the main jet 12. Under these conditions fuel is drawn only from the idle jet. However, with my improved carburetor it will be seen that with the throttle valve 18 moved substantially to the position shown in FIG. 4, that is, to the full open position, the valve 18 has been rotated to a position past vertical providing greater separation between jet 22 and the ice mass 30, preventing the flow of fuel to idle jet 22. Under these conditions, namely, with the throttle valve 18 positioned as shown in FIG. 4, the negative pressure on the fuel system, namely, the passages 21, 19 and 14, due to the formation of ice, is removed. Therefore, the flow of air through the venturi system of the carburetor again becomes sufficient to draw fuel from the main jet 12, assuring continued operation of the engine. In addition to providing a greater separation between jet 22 and the ice mass 30 when present, the ice is exposed to the incoming fuel-air mixture more quickly than with conventional throttle valves, thus aiding in the erosion of the ice mass substantially as soon as it forms.

From the foregoing it will be seen that I have devised an improved, simple and efficient means for effectively reducing the effects of carburetor ice on the fuel metering function of the carburetor or throttle body of internal combustion engines. As is understood, the volume of fuel compared to the volume of air required for efficient operation is very small. Thus, in the presence of ice in a carburetor not equipped with my improvement, the existence of only slightly more negative pressure at the mouth of the idle jet than exists at the discharge end of the main jet is adequate to cause complete cessation of flow of fuel from the main jet. While at first glance it would appear that the icing conditions depicted in FIG. 4 and with the throttle valve fully open, there would be some flow of fuel from the main jet 12 even in carburetors without my invention, such does not appear to be the case. With the engines that I have experimented with when iced as in FIG. 4 and without my improved throttle, flow through nozzle 12 is not sufficient to keep the engine running, due to the lack of negative pressure at the end of the nozzle to inspirate the fuel. At the same time, due to the small size of the idle jet 22, such fuel as does come out of that jet is not sufficient. My invention thus assures, under conditions in which ice may be present, that fuel is drawn from the proper source, namely, through the main jet 12, which, due to its location away from the ice body on the butterfly valve is not per se affected by such ice. Furthermore, under certain intermediate throttle settings, in the presence of ice, it is known that over-rich mixtures occur. I have found that my improvement eliminates or greatly reduces such over-riching of the fuel-air mixture.

While I have shown my invention in but one form, it will be obvious to those skilled in the art that it is not so limited, but is susceptible of various changes and modifications without departing from the spirit thereof.

What I claim is:

1. In a carburetor of the kind having a passage in which fuel is mixed with in coming air and further provided with an idle jet communicating with the passage through a wall defining the passage and a main jet, the improvment comprising, a throttle valve mounted on a shaft for controlling the flow of the fuel air mixture through said passage, said valve having the portion thereof adjacent the idle jet bent upstream of the opposite portion, with said opposite portion being perpendicular to the longitidinal axis of said passage in its closed position, and with said bent portion positioned upstream of said idle jet and in spaced relation with said passage wall in an idle position.

* * * * *